US008413705B2

(12) United States Patent
Castel

(10) Patent No.: US 8,413,705 B2
(45) Date of Patent: Apr. 9, 2013

(54) ORIENTABLE PANEL OF A ROOFING DEVICE

(76) Inventor: Jean-Louis Castel, Poitiers (FR)

( * ) Notice: Subject to any disclaimer, the term of this patent is extended or adjusted under 35 U.S.C. 154(b) by 0 days.

(21) Appl. No.: 13/062,846

(22) PCT Filed: Sep. 8, 2009

(86) PCT No.: PCT/FR2009/051690

§ 371 (c)(1),
(2), (4) Date: Mar. 8, 2011

(87) PCT Pub. No.: WO2010/029252

PCT Pub. Date: Mar. 18, 2010

(65) Prior Publication Data

US 2011/0162808 A1 Jul. 7, 2011

(30) Foreign Application Priority Data

Sep. 9, 2008 (FR) ..... 08 56044

(51) Int. Cl.
*E06B 3/32* (2006.01)

(52) U.S. Cl. ..... 160/107; 160/218; 160/130; 160/174 R; 49/64; 49/74.1; 49/80.1

(58) Field of Classification Search ..... 160/107, 160/130, 167 R, 179, 218; 49/64, 67, 63, 49/74.1, 77.1, 80.1; 52/202, 473
See application file for complete search history.

(56) References Cited

U.S. PATENT DOCUMENTS 1,785,682 A * 12/1930 Hamilton ..... 454/221
2,337,785 A * 12/1943 Thurman ..... 160/60
2,403,246 A * 7/1946 Sperling ..... 160/92
2,520,272 A * 8/1950 Bopp et al. ..... 160/176.1 V
2,561,846 A * 7/1951 Curry ..... 160/91
2,607,963 A * 8/1952 Ansel ..... 49/392
2,613,928 A * 10/1952 Cote ..... 49/81.1
2,889,591 A * 6/1959 Pratt ..... 49/390
3,039,155 A * 6/1962 Iacovoni ..... 49/65
3,180,246 A * 4/1965 Johnson ..... 454/319
3,430,383 A * 3/1969 Brenner ..... 49/80.1
3,638,383 A * 2/1972 Escudero Ribas ..... 52/473
3,782,051 A * 1/1974 Quinif ..... 52/473
4,081,934 A * 4/1978 Franz ..... 52/171.3
4,327,795 A * 5/1982 Wheeler ..... 160/98
4,369,828 A * 1/1983 Tatro ..... 160/107

(Continued)

FOREIGN PATENT DOCUMENTS

FR 2284747 A1 4/1976
FR 2676079 A1 11/1992

OTHER PUBLICATIONS

International Search Report, dated Feb. 16, 2010, from corresponding PCT application.

*Primary Examiner* — Katherine Mitchell
*Assistant Examiner* — Johnnie A Shablack
(74) *Attorney, Agent, or Firm* — Young & Thompson

(57) ABSTRACT

An adjustable flap, designed for the production of a covering device, includes a section (12) that is made of translucent material with length L1 and longitudinal axis A1 around which the flap (10) is articulated to rotate, and at least one slat (14) that is made of opaque material with length L2, L2 that is at most equal to L1, and longitudinal axis A2, A2 that is parallel to A1, around which the slat (14) is articulated to rotate relative to the flap.

2 Claims, 4 Drawing Sheets

U.S. PATENT DOCUMENTS 4,427,048 A * 1/1984 Osaka et al. ..... 160/107
4,553,360 A * 11/1985 Colombo ..... 52/202
4,602,456 A * 7/1986 Tatro ..... 49/74.1
4,658,806 A * 4/1987 Boozer ..... 126/703
4,850,138 A * 7/1989 Watanabe et al. ..... 49/82.1
5,203,394 A * 4/1993 Hailey ..... 160/166.1
5,392,577 A * 2/1995 D'Onofrio et al. ..... 52/473
5,737,874 A * 4/1998 Sipos et al. ..... 49/67
5,941,021 A * 8/1999 Valls et al. ..... 49/92.1
6,041,843 A * 3/2000 Mullet ..... 160/36
6,478,072 B1 * 11/2002 Allman ..... 160/89
6,536,174 B2 * 3/2003 Foster et al. ..... 52/473
6,543,188 B1 * 4/2003 Poma et al. ..... 52/78
6,604,322 B2 * 8/2003 Horn et al. ..... 49/64
6,736,185 B2 * 5/2004 Smith et al. ..... 160/107
6,837,003 B2 * 1/2005 Nien ..... 49/67
6,877,285 B2 * 4/2005 Poma et al. ..... 52/202
6,886,298 B2 * 5/2005 Nien ..... 52/202
6,996,934 B2 * 2/2006 Briscoe et al. ..... 49/67
7,131,480 B2 * 11/2006 Briscoe et al. ..... 160/117
7,721,783 B2 * 5/2010 Colson et al. ..... 160/176.1 R
2010/0263804 A1 * 10/2010 Shprung ..... 160/133

* cited by examiner

ORIENTABLE PANEL OF A ROOFING DEVICE

This invention relates to an adjustable flap that is designed for the production of a covering device of an outside surface or a building and that makes it possible to ensure variable protection according to the weather conditions.

BACKGROUND OF THE INVENTION

Covering devices that come in the form of retractable rolling roofs or roll-up curtains are known.

Although they offer a design that can be airtight in the closed position, these first devices of the prior art do not make it possible to adjust the desired amounts of shade and sun on the covered surface.

Devices with flaps that can be adjusted by rotation, such as Venetian blinds, whereby said flaps overlap one another in the closed position, are also known.

These second devices of the prior art make it possible to distribute and to adjust the desired amount of shade and sun on the covered surface.

However, the overlapping of the flaps does not allow an effective seal against rain in the closed position, more particularly in the case of a horizontal roof.

The French patent published under the reference FR-2,676,079 in the name of the same applicant as this invention proposes a covering device that offers an effective seal against bad weather in the closed position while allowing adjustment and distribution of the amount of shade and sun. To do this, this covering device of the prior art consists of adjustable flaps whose end profiles interlock in the closed position, where one of the profiles forms a channel and the other a baffle.

Thus, the change in orientation of the flaps relative to an axis of rotation allows an adjustment and a distribution of the amounts of shade and sun on the covered surface.

And, when the flaps are in the closed position, the interlocking of the outside profile in a baffle in the outside profile in a channel prevents the passage of water, each profile that forms a channel making it possible to evacuate the water toward the outside of the covering device.

This covering device of the prior art has a major drawback: the flaps that are used are necessarily opaque so as to be able to implement effective and total protection against the sun.

In the case of rainy or threatening weather conditions, an attempt is generally made to protect oneself against bad weather and to prevent the risk of rain by closing said covering device. The opaque flaps are then in the closed position, preventing any light ray from penetrating through said device.

However, in the case of overcast weather or at nightfall, for example, it may be advantageous that the covering device in the closed position allows the light rays to penetrate before resorting to any lighting.

SUMMARY OF THE INVENTION

Also, the purpose of this invention is to remedy the drawbacks of the prior art by proposing a conception of an adjustable flap that is designed for the production of a covering device that makes it possible to ensure protection against inclement weather independently of protection against light.

For this purpose, the invention has as its object an adjustable flap, designed for the production of a covering device, comprising a section that is made of translucent material with length L1 and longitudinal axis A1 around which said flap is articulated to rotate, and at least one slat that is made of opaque material with length L2, L2 that is at most equal to L1 and longitudinal axis A2, A2 that is parallel to A1, around which said slat is articulated to rotate relative to said flap.

Thus, the adjustable flap according to this invention is able to implement maximum protection against the light rays in a first end position, variable protection against the light rays in intermediate positions, and airtight protection against rain but allowing light to pass into a second end position.

BRIEF DESCRIPTION OF THE DRAWINGS

Other characteristics and advantages will emerge from the following description of the invention, a description that is provided only by way of example, relative to the accompanying drawings, in which.

DETAILED DESCRIPTION OF THE INVENTION

This invention relates to an adjustable flap and more particularly to a flap that is designed for the production of a covering device of an outside surface, such as a terrace of a dwelling, a café, a storefront, or else for a veranda roof, a greenhouse roof, or for the attractiveness of public spaces.

Of course, the invention also covers any other application of the adjustable flap according to the invention for the production of a cover or for another use.

According to a first advantage relative to the devices of the prior art, the adjustable flap 10 according to the invention offers a design that makes it possible to adjust the amount of light and shade gradually and homogeneously on the covered surface by modifying the orientation of said flap between two end positions: a first position in which said flap is essentially translucent, and a second position in which said flap is essentially opaque.

For this purpose, said flap 10 comprises a section 12 that is made of translucent material with a length L1 and a longitudinal axis A1 around which said flap 10 is articulated to rotate, and at least one slat 14 that is made of opaque material with length L2, L2 that is at most essentially equal to L1, and longitudinal axis A2, A2 that is essentially parallel to A1, around which said slat 14 is articulated to rotate relative to said flap 10.

In a preferred embodiment of the invention, putting the adjustable flap 10 into rotation around its longitudinal axis A1 drives a rotation of the opaque slat 14 around its longitudinal axis A2 by gravity.

Of course, mechanical, motorized or manual means can also be provided to drive the opaque slat 14 in rotation around its longitudinal axis A2 and to keep it in a given position.

The translucent section 12 can be made of polycarbonate, in particular marketed under the trademark MAKROLON®, methyl polymethacrylate (PMMA), in particular marketed under the trademark PLEXIGLAS®, or any other polymer.

The opaque slat 14 can be made of opaque plastic material, sheet metal, aluminum, . . . .

The adjustable flap 10 can be put into rotation by different mechanical means, such as a mechanical system that comprises a rod and a connecting rod or an eccentric wheel, or by motorized means.

The choice between these different means for putting into motion an adjustable flap 10 is not the object of this invention, and it is therefore left to one skilled in the art who has all of the knowledge necessary for implementing it.

Figure 1A:
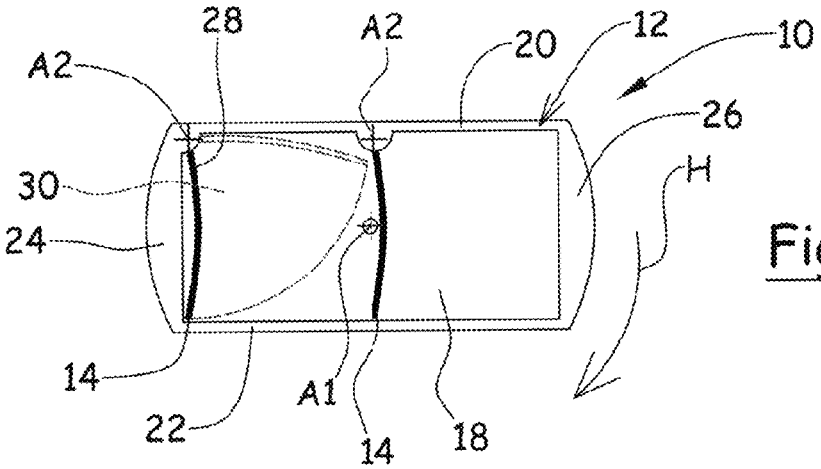
FIGS. 1A to 1C diagrammatically show a block diagram of the operation of a profile-view adjustable flap in a first embodiment according to the invention, FIGS. 2A to 2D diagrammatically show a block diagram of the operation of a profile-view adjustable flap in a second embodiment according to the invention.
Figure 1B:
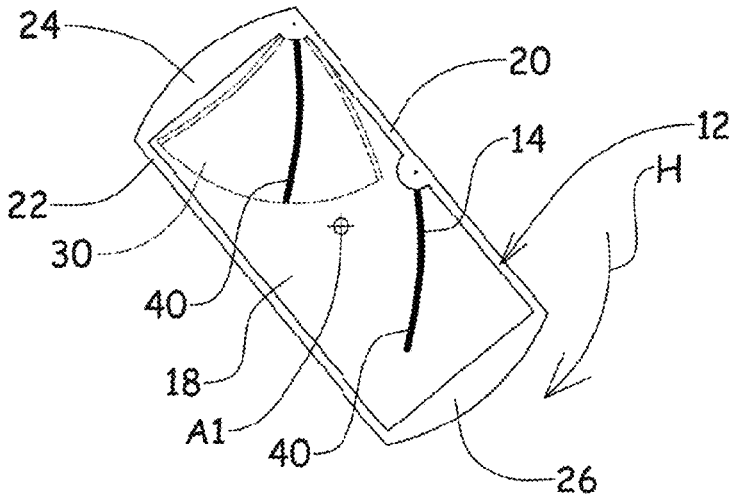
Figure 1C:
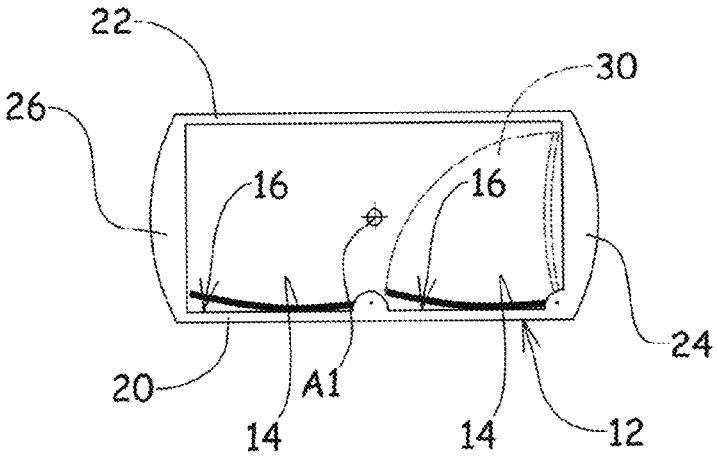
Figure 2A:
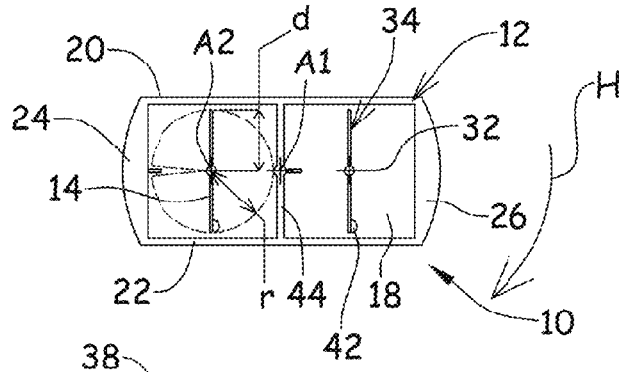
Figure 2B:
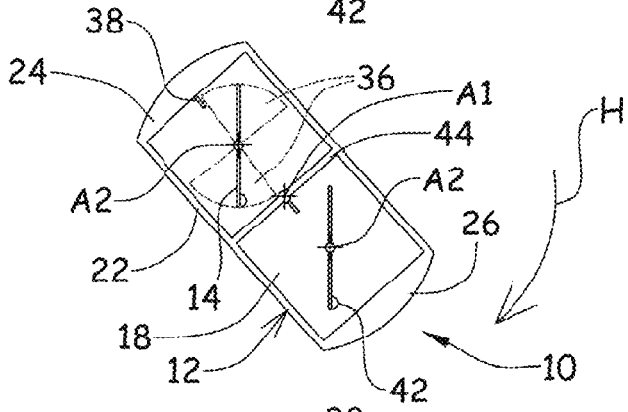
Figure 2C:
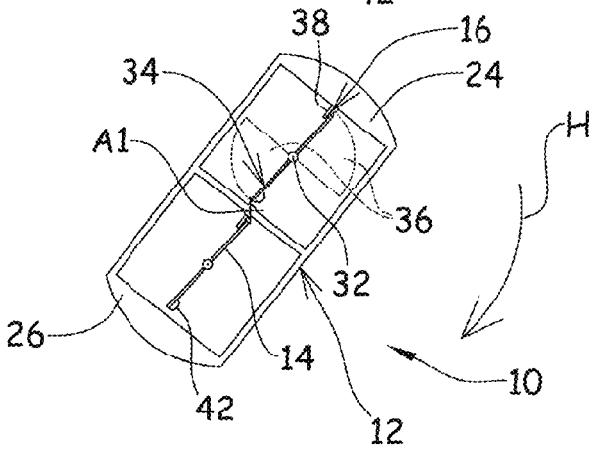
Figure 2D:
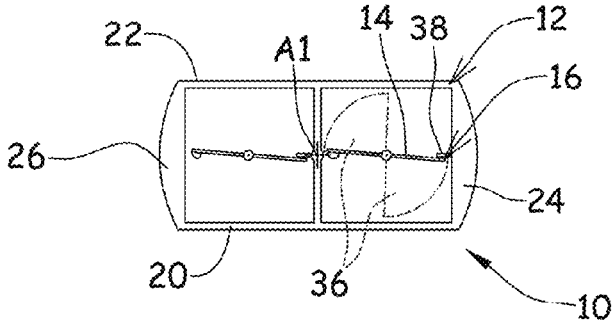

So as to gradually vary the protection against the light rays, putting the adjustable flap 10 into rotation around its longitudinal axis A1 entrains a gradual tilting of said slat 14 between two end positions: a translucent position, illustrated in FIGS. 1A and 2A, in which said slat allows a maximum amount of light rays to pass, and an opaque position, illustrated in FIGS. 1C and 2D, in which said slat 14 allows a minimum amount of light rays to pass.

In one preferred embodiment, the section 12 of an adjustable flap 10 comprises at least one protective compartment 18 that is essentially closed around at least one slat 14 so as to prevent dust, leaves or any other flying debris from hampering the rotation of a slat 14 or making the translucent section 12 partially opaque.

Advantageously, a compartment 18 is manufactured with the section 12, and it has a volume that makes it possible for the slat 14 to tilt between the two end positions, translucent and opaque.

More specifically, putting the adjustable flap 10 into rotation around its longitudinal axis A1 drives a rotation of the opaque slat 14 around its longitudinal axis A2 up to a stop 16 that is integrated with said compartment 18, whereby said stop 16 makes it possible to keep said slat 14 in the opaque position as illustrated in FIGS. 1C and 2D.

In a preferred embodiment, a compartment 18 has an essentially polygonal cross-section and comprises at least four surfaces that essentially face each other two by two.

Thus, in a translucent position that is illustrated in FIGS. 1A and 2A, a compartment 18 comprises at least a first primary surface 20 that essentially faces a second primary surface 22 as well as at least one first lateral surface 24 that essentially faces a second lateral surface 26, whereby said essentially vertical lateral surfaces (24, 26) connect said essentially horizontal primary surfaces (20, 22).

According to a first variant embodiment, illustrated in FIGS. 1A to 1C, the longitudinal axis A2, located at a longitudinal edge 28 of the opaque slat 14, is brought to the first primary surface 20 of a compartment 18 of the section 12 so as to allow the tilting of the slat 14 between its two end positions.

In this first variant, the stop 16 that makes it possible to keep the slat 14 in the opaque position is formed by the first primary surface 20 of the section 12 to which is brought the longitudinal axis A2 of the slat 14, as illustrated by FIGS. 1A to 1C.

More specifically, if the adjustable flap 10 is put into rotation in a clockwise direction, illustrated by the arrows H, or a counterclockwise direction, the arrangement of the surfaces (20, 22, 24, 26) and the arrangement of the longitudinal axis A2 of a slat 14 at the primary surface 20 are produced in such a way as to release the rotation of the slat 14 in the counterclockwise direction, or in the clockwise direction, and over an angular sector 30 that essentially corresponds to a quarter turn in the compartment 18.

Thus, in the translucent position of the flap that is illustrated in FIG. 1A, the opaque slat 14 is suspended essentially vertically in the compartment 18 by its longitudinal axis A2 so as to allow a maximum amount of light rays to pass.

When the flap 10 is put into rotation, and as illustrated in FIG. 1B, the slat 14 enters into rotation relative to the compartment 18. The first quarter turn made by the flap 10 drives a rotation of the slat 14 over the corresponding angular sector 30, and this is done until the slat 14 comes to rest on the stop 16 that is formed by the first primary surface 20.

During this first quarter turn of the flap 10, said slat 14 remains essentially vertical under the effect of gravity, and the flap 10 therefore remains essentially translucent.

During the second quarter turn of the flap 10, the slat 14 is locked by the stop 16 in the compartment 18 and is therefore gradually driven from an essentially vertical position to an essentially horizontal position, which gradually increases the amount of shade provided by the flap 10 on the covered surface.

The maximum opacity of the flap 10 is obtained at the end of the second quarter turn when the slat 14 is kept in essentially horizontal position by the first primary surface 20 that forms a stop.

So as to gradually come back from the opaque position of the flap 10 that is illustrated in FIG. 1C to the translucent position of the flap 10, the rotation of the flap 10 is to be implemented in the reverse direction of the rotation that has led the flap 10 from its translucent position to its opaque position.

According to a second variant embodiment, illustrated in FIGS. 2A to 2D, the longitudinal axis A2 is located close to the center 32 of the profile 34 of the slat 14, and said longitudinal axis A2 is brought to at least a suitable distance d from the surfaces (20, 22, 24, 26) of the compartment 18 of the section 12 so as to allow the tilting of the slat 14 between its two end positions.

With the longitudinal axis A2 of the slat 14 being brought to the center 32 of its profile 34, the distance d is essentially longer than the radius r of the cylinder, illustrated in FIG. 2A, making it possible for the slat 14 to make a complete turn on itself around its longitudinal axis A2.

In this second variant, the stop 16 that makes it possible to keep the slat 14 in the opaque position is formed by at least one lug 38 that is carried by at least one of the lateral surfaces (24, 26) of the compartment 18 of the section 12.

More specifically, if the adjustable flap 10 is put into rotation in the clockwise direction, illustrated by the arrows H, or a counterclockwise direction, the arrangement of the surfaces (20, 22, 24, 26) and the arrangement of the longitudinal axis A2 of a slat 14 in the compartment 18 that is formed by the surfaces (20, 22, 24, 26) are implemented so as to release the rotation of the slat 14 in the clockwise and counterclockwise directions over two angular sectors 36 that correspond essentially to a quarter turn in the compartment 18.

Thus, in the translucent position of the flap that is illustrated in FIG. 2A, the opaque slat 14 is suspended essentially vertically in the compartment 18 by its longitudinal axis A2 so as to allow a maximum amount of light rays to pass.

When the flap 10 is put into rotation, and as illustrated in FIG. 2B, the slat 14 enters into rotation relative to the compartment 18. The first quarter turn that is made by the flap 10 drives a rotation of the slat 14 over the corresponding angular sector 36 and this is done until the slat 14 comes to rest on the stop 16 that is formed by the lug 38 that is carried by one of the lateral surfaces (24, 26) of the compartment 18.

During this first quarter turn of the flap 10, said slat 14 remains essentially vertical under the effect of gravity, and the flap 10 therefore remains essentially translucent.

During the second quarter turn of the flap 10, and as illustrated in FIG. 2C, the slat 14 is locked by the stop 16 in the compartment 18 and is therefore gradually driven from an essentially vertical position to an essentially horizontal position, which gradually increases the amount of shade provided by the flap 10 on the covered surface.

The maximum opacity of the flap 10 is obtained at the end of the second quarter turn when the slat 14 is kept in essentially horizontal position by the lug 38 that is carried by one of the lateral surfaces (24, 26).

So as to gradually come back from the opaque position of the flap 10 that is illustrated in FIG. 2D to the translucent position of the flap 10, the rotation of the flap 10 is to be implemented in the reverse direction of the rotation that has led the flap 10 from its translucent position to its opaque position.

So as to promote the tilting of a slat 14 between the opaque and translucent positions, and as illustrated in FIGS. 1A to 1C, at least one portion 40 of the profile 34 of said slat 14 is curved in such a way as to move the center of gravity of said slat 14 away from its profile 34.

Still for the purpose of promoting the tilting of a slat 14 between the opaque and translucent positions, and as illustrated in FIGS. 2A to 2D, at least one edge 28 of said slat 14 comprises a counterweight 42 in such a way as to move the center of gravity of said slat 14 away from its profile 34.

Advantageously, and as illustrated in the different figures, an adjustable flap 10 comprises at least two opaque slats 14 so as to multiply its protective width.

In the case where a flap 10 comprises at least two slats 14, said adjustable flap 10 can comprise at least one protective compartment 18 for each slat 14, a rib 44 that comes to separate two adjacent compartments 18 of the same adjustable flap 10. Said rib 44 acts as lateral surfaces (24, 26) of said compartments 18, and it simultaneously makes it possible to stiffen the section 12 that forms said flap 10.

The adjustable flap 10 according to the invention is designed for the production of a covering device 50 of an outside surface, such as a terrace of a dwelling, a café, a storefront, or else for a veranda roof, a greenhouse roof, or for the attractiveness of public spaces.

Figure 3:
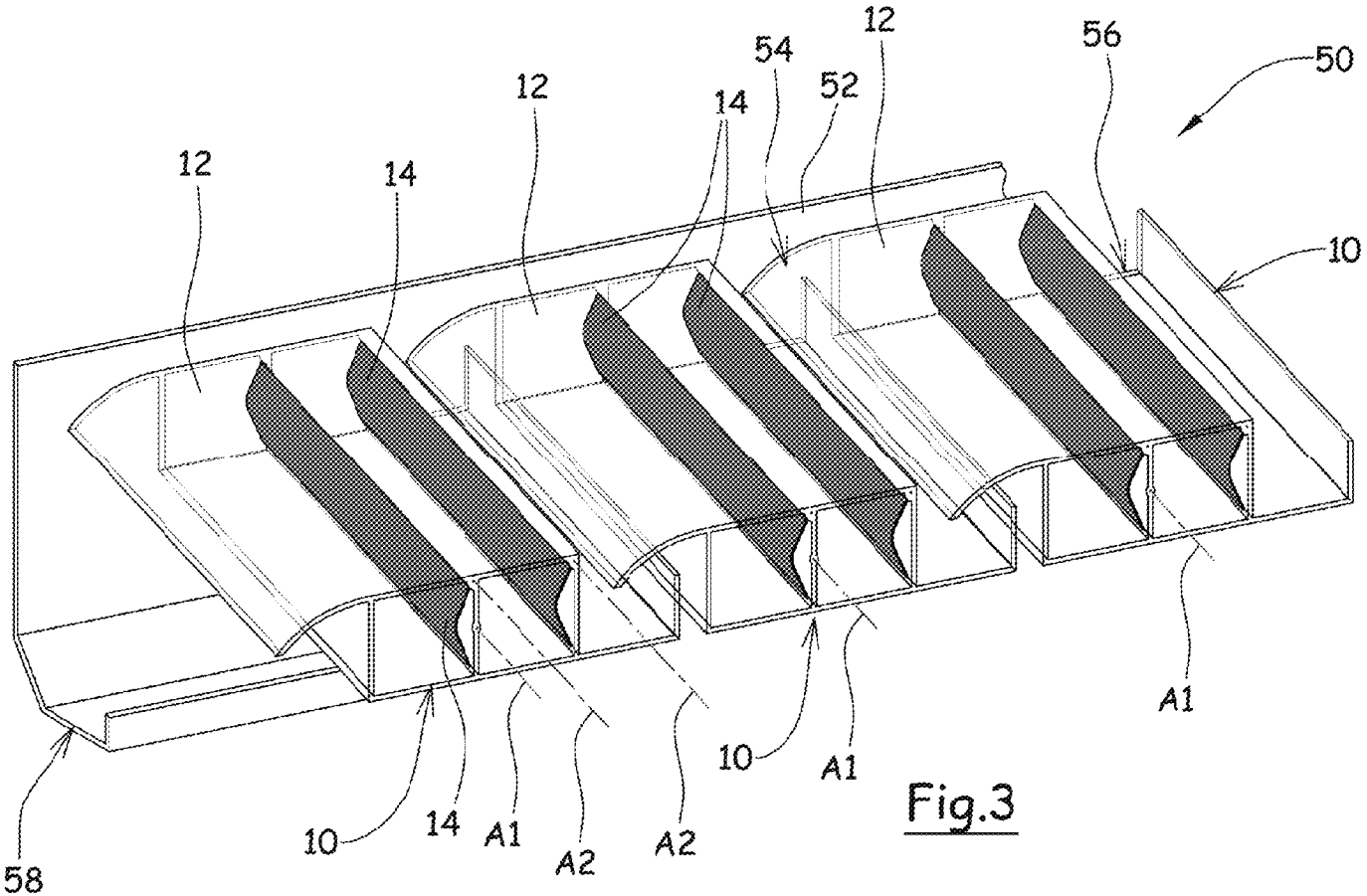
FIGS. 3 and 4 show in perspective, respectively in a translucent position and in an opaque position, a covering device that is produced using an adjustable flap according to the invention.
Figure 4:
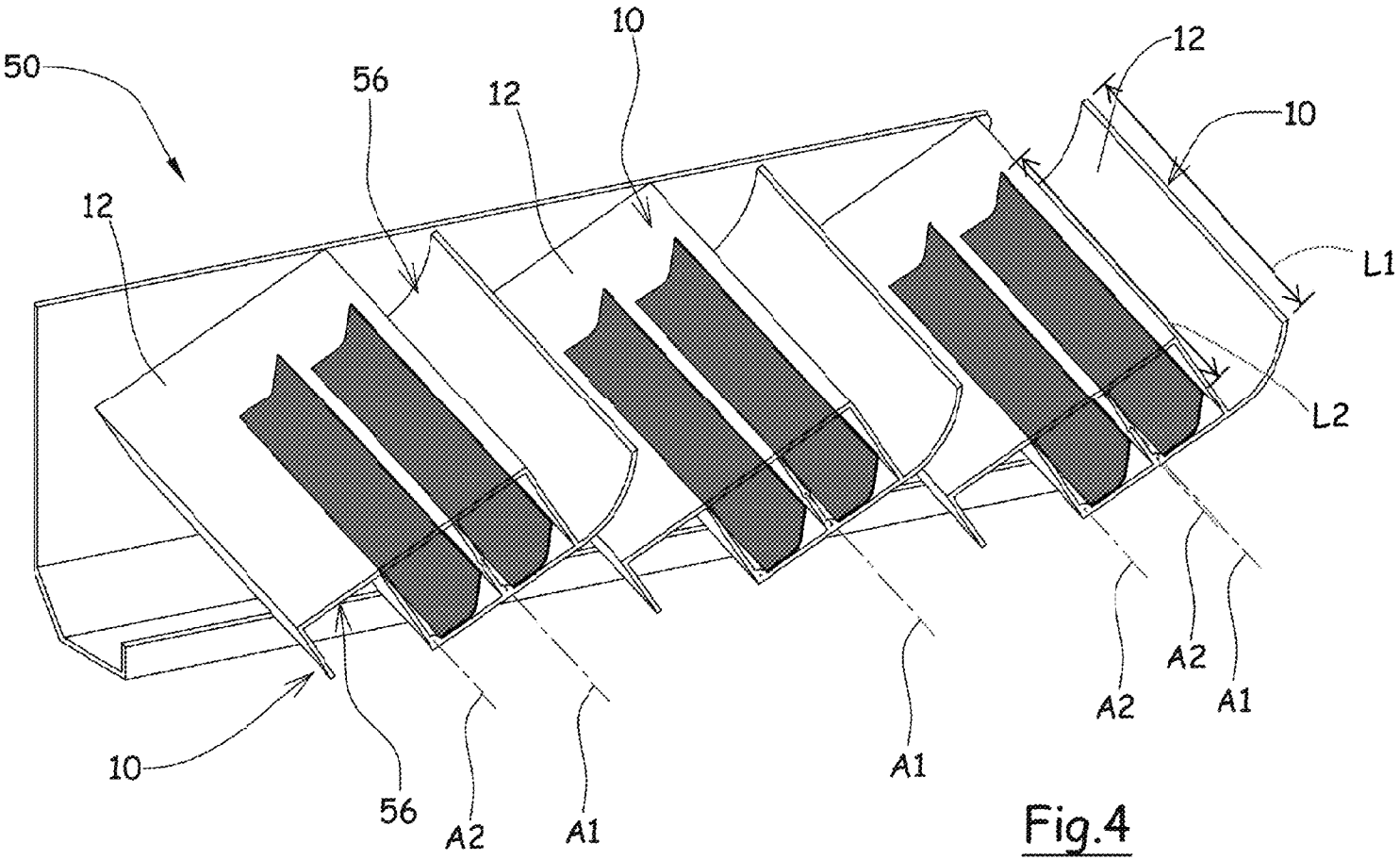

Such a covering device 50 is shown diagrammatically in FIGS. 3 and 4, or in the translucent closed position and in the opaque position.

A covering device 50 comprises flaps 10 in rotation around their longitudinal axes A1, whereby said axes A1 are brought to a carrying frame 52 at each end of the sections 12 that form said flaps 10.

Said flaps 10 are mounted parallel to said carrying frame 52 and are spaced by the same distance that is suitable for forming an essentially continuous covering in their translucent position.

A control system, not illustrated, with connecting rods or eccentric wheels is generally provided so as to drive simultaneously in rotation all of the flaps 10 that form said covering device 50.

Thus, the set of flaps 10 can be put into rotation and stopped in all of the positions that are located between the translucent closed position that is illustrated in FIG. 3 in which the slats 14 of said flaps 10 are essentially vertical, and the opaque position that is illustrated in FIG. 4, in which the slats 14 of said flaps 10 are essentially horizontal.

It is noted that the adjustable flap 10 according to the invention duly makes it possible to produce a covering device that makes it possible to gradually and homogeneously adjust the amount of light and shade on the covered surface by modifying the orientation of said flaps between their two translucent and opaque positions.

According to a second advantage relative to the devices of the prior art, an adjustable flap 10 according to the invention is able to ensure airtight protection against inclement weather independently of protection against light. This improved embodiment is illustrated in FIGS. 3 and 4.

According to this improved embodiment, the front end 54 and the rear end 56 of a section 12 of a flap 10 are interlocked, whereby the front end 54 forms a baffle and the rear end 56 forms a channel for evacuating water.

Thus, when the flaps 10 are in the translucent closed position, the interlocking of the front end 54 in a baffle in the rear end 56 in a channel prevents water from passing under the thus produced covering.

Advantageously, the carrying frame 52 comprises a U-shaped trough 58 below each rear end 56 of a section 12 of a flap 10 so as to collect and to evacuate water toward the outside of the covering device.

Sealing means, such as joints, can also be provided between the front end 54 and the rear end 56 of the sections 12.

As FIG. 3 illustrates, with a translucent adjustable flap 10 and in a translucent position comprising opaque slats 14 in an essentially vertical position, a maximum amount of light rays passes through the covering device 50. In contrast, since the front ends 54 and the rear ends 56 of the sections 12 are interlocked, protection against rain is ensured.

The invention claimed is:

1. An adjustable flap assembly designed for the production of a covering device, comprising:

an adjustable flap configured for gradually and homogeneously adjusting an amount of light and shade on a covered surface by modifying an orientation of said flap between two end positions, the two end positions being a first position in which said flap is essentially translucent, and a second position in which said flap is essentially opaque, said flap (10) comprising a section (12) of translucent material with a first length (L1) and a first longitudinal axis (A1) around which said flap (10) is articulated to rotate;

plural slats (14) of opaque material with a second length (L2) and a respective second longitudinal axis (A2), the second length (L2) being at most equal to the first length (L1), the second longitudinal axis (A2) being parallel to the first longitudinal axis (A1), around which respective second longitudinal axis (L2) of each said slat (14) is articulated to rotate relative to said flap (20), wherein rotation of the flap (10) about the first longitudinal axis (A1) drives a rotation of each said slat (14) around the corresponding respective second longitudinal axis (A2) by a force of gravity, and wherein, the rotation of the flap (10) around the first longitudinal axis (A1) gradually varies protection against light rays by entraining a gradual tilting of said slats (14) between the two end positions so that said flap (10) defines i) a translucent position in which said slats (14) allow a maximum amount of light rays to pass and ii) an opaque position in which said slats (14) allow a minimum amount of light rays to pass;

a stop associated with each said slat (14), wherein the rotation of the flap (10) about the first longitudinal axis (A1) drives the rotation of each said slat (14) around the corresponding respective second longitudinal axis (A2) by gravity up to the corresponding stop (16), the stop (16) keeping each said slat (14) in the opaque position;

a compartment (18) associated with each said slat (14), each said compartment (18) having an essentially polygonal cross-section and comprising at least four surfaces that essentially face each other two by two, wherein, in the translucent position, each said compartment (18) comprises at least a first primary surface (20) that essentially faces a second primary surface (22), and at least one first lateral surface (24) that essentially faces a second lateral surface (26), said first and second lateral surfaces (24, 26) connecting said first and second primary surfaces (20, 22), wherein, each said second longitudinal axis (A2) is located at a longitudinal edge (28) of the corresponding slat (14) and at the first primary surface (20) of the corresponding compartment (18), a first rotation of the flap (10) in a first clockwise direction releases the rotation of each slat (14) in a second clockwise direction, and over an angular sector (30) essentially corresponding to a quarter turn in said compartment (18) to move the flap (10) to the translucent position with each slat (14) suspended essentially vertically in the compartment (18) at the second longitudinal axis (A2) so as to allow a maximum amount of light rays to pass, the first clockwise direction being opposite the second clockwise direction, a second rotation of the flap (10) in the first clockwise direction causes each slat (14) to enter into further rotation relative to the compartment (18) to drive a further rotation of each slat (14) over the angular sector (30) until each slat (14) comes to rest on the corresponding stop (16), during the second rotation of the flap (10), each slat (14) remains in an essentially vertical position under the effect of gravity and the flap (10) remains essentially translucent, and a third rotation of the flap (10) in the first clockwise direction moves each slat (14) gradually driven from the essentially vertical position to an essentially horizontal position gradually thereby increasing the amount of shade provided by the flap (10) on the covered surface with a maximum opacity of the flap (10) being obtained at the end of the third rotation with each slat (14) in the essentially horizontal position.

2. An adjustable flap assembly designed for the production of a covering device, comprising:

an adjustable flap configured for gradually and homogeneously adjusting an amount of light and shade on a covered surface by modifying an orientation of said flap between two end positions, the two end positions being a first position in which said flap is essentially translucent, and a second position in which said flap is essentially opaque, said flap (10) comprising a section (12) of translucent material with a first length (L1) and a first longitudinal axis (A1) around which said flap (10) is articulated to rotate;

plural slats (14) of opaque material with a second length (L2) and a respective second longitudinal axis (A2), the second length (L2) being at most equal to the first length (L1), the second longitudinal axis (A2) being parallel to the first longitudinal axis (A1), around which respective second longitudinal axis (L2) of each said slat (14) is articulated to rotate relative to said flap (20), wherein rotation of the flap (10) about the first longitudinal axis (A1) drives a rotation of each said slat (14) around the corresponding respective second longitudinal axis (A2) by a force of gravity, and wherein, the rotation of the flap (10) around the first longitudinal axis (A1) gradually varies protection against light rays by entraining a gradual tilting of said slats (14) between the two end positions so that said flap (10) defines i) a translucent position in which said slats (14) allow a maximum amount of light rays to pass and ii) an opaque position in which said slats (14) allow a minimum amount of light rays to pass;

a stop associated with each said slat (14), wherein the rotation of the flap (10) about the first longitudinal axis (A1) drives the rotation of each said slat (14) around the corresponding respective second longitudinal axis (A2) by gravity up to the corresponding stop (16), the stop (16) keeping each said slat (14) in the opaque position;

a compartment (18) associated with each said slat (14), each said compartment (18) having an essentially polygonal cross-section and comprising at least four surfaces that essentially face each other two by two, wherein, in the translucent position, each said compartment (18) comprises at least a first primary surface (20) that essentially faces a second primary surface (22), and at least one first lateral surface (24) that essentially faces a second lateral surface (26), said first and second lateral surfaces (24, 26) connecting said first and second primary surfaces (20, 22), wherein, each said second longitudinal axis (A2) is located at a center (32) of a profile (34) of the corresponding slat (14), a first rotation of the flap (10) in a first clockwise direction releases the rotation of each slat (14) in an opposite, second clockwise direction over two angular sectors (36) corresponding essentially to a quarter turn in the compartment (18), to move the flap (10) to the translucent position with each slat (14) suspended essentially vertically in the compartment (18) to allow a maximum amount of light rays to pass, a second rotation of the flap (10) in the first clockwise direction enters each slat (14) into rotation relative to the compartment (18) until each slat (14) comes to rest on the corresponding stop (16), during the second rotation each slat (14) remaining essentially vertical under the effect of gravity and the flap (10) therefore remains essentially translucent, a third rotation of the flap (10) in the first clockwise direction gradually drives each slat (14) from the essentially vertical position to an essentially horizontal position to gradually increases the amount of shade provided by the flap (10) on the covered surface, and at an end of the third rotation, a maximum opacity of the flap (10) when each slat (14) being kept in the essentially horizontal position.

* * * * *